United States Patent [19]

Jones

[11] Patent Number: 4,547,761

[45] Date of Patent: Oct. 15, 1985

[54] DISTRESS LIGHT AND SIGNAL SYSTEM

[76] Inventor: Richard D. Jones, 1174 Highland Rd., Mundelein, Ill. 60060

[21] Appl. No.: 559,731

[22] Filed: Dec. 9, 1983

[51] Int. Cl.[4] ..... G08B 5/36; G08B 5/38

[52] U.S. Cl. ..... 340/331; 340/332

[58] Field of Search ..... 340/331, 332, 326, 50; 315/133; 323/906

[56] References Cited

U.S. PATENT DOCUMENTS

| | | | |
|---|---|---|---|
| 803,348 | 10/1905 | Lebeis . | |
| 881,264 | 3/1908 | Schermerhorn . | |
| 1,028,591 | 6/1912 | Moyes et al. . | |
| 1,299,854 | 4/1919 | Neely . | |
| 1,375,540 | 4/1921 | Smith . | |
| 1,669,055 | 5/1928 | Hogg . | |
| 1,703,224 | 2/1929 | Challis et al. . | |
| 1,713,021 | 5/1929 | Bryce . | |
| 1,806,915 | 5/1931 | Pinkus . | |
| 2,026,385 | 12/1935 | Heyde . | |
| 2,208,297 | 7/1940 | Lipp . | |
| 2,346,325 | 4/1944 | Oliver . | |
| 2,638,583 | 5/1953 | Edwards, Jr. . | |
| 2,705,751 | 4/1955 | Harris et al. . | |
| 2,718,635 | 9/1955 | Sabiers . | |
| 2,825,803 | 3/1958 | Newborough . | |
| 2,890,444 | 6/1959 | Turk . | |
| 2,910,680 | 10/1959 | McLain . | |
| 3,122,736 | 7/1961 | Weber . | |
| 3,473,148 | 10/1969 | Koenig | 340/331 |
| 3,593,016 | 7/1971 | Gerdel . | |
| 3,599,201 | 8/1971 | Clardy et al. | 340/326 |
| 3,911,425 | 10/1975 | Muncheryan | 340/326 |
| 3,913,092 | 10/1975 | Klingenberg | 340/332 |
| 4,003,040 | 1/1977 | Browand . | |
| 4,314,198 | 2/1982 | Rogers | 323/351 |
| 4,387,362 | 6/1983 | Gosswiller | 340/81 |

*Primary Examiner*—John W. Caldwell, Sr.
*Assistant Examiner*—Sharon L. Hodgkins
*Attorney, Agent, or Firm*—Joseph R. Marcus; Robert S. Beiser; Gerald S. Schur

[57] ABSTRACT

A distress light and signal system including a light adapted to be anchored in the ground in proximity to a road passing by a house. The light includes a switch for selectively actuating the light in an emergency from within the house and is powered by a solar collector and a rechargeable battery. Information is retained at a location remote from the house including directions for use by a person responding to the emergency. The system includes immediate retrieval of the information upon notification of the existence of an emergency at the house. With these features, a person responding to an emergency may reach the house rapidly by visually locating the light upon reaching the vicinity of the house.

5 Claims, 6 Drawing Figures

DISTRESS LIGHT AND SIGNAL SYSTEM

BACKGROUND OF THE INVENTION

The present invention relates to a distress light and signal system and, more particularly, to a distress light and signal system wherein a person responding to an emergency may reach a house rapidly by visually locating a light upon reaching the vicinity of the house.

In the past, there have been many diverse types of emergency warning devices for the home. These have included smoke detectors, burglar alarms, and other such devices designed to alert those in and/or outside the home of the existence of an emergency requiring prompt attention. However, despite the number and variety of such devices, a serious problem exists which has yet to be addressed in a satisfactory manner.

In particular, there has been a serious need for a distress light and signal system for aiding those responding to emergencies. It has often been the case, particularly with those living in rural areas, that firemen, policemen, and paramedics have had considerable difficulty in locating the site of an emergency, and the lost time has often resulted in unnecessary damage to property and, most importantly, aggravation of serious medical conditions and even death. While many communities have implemented the utilization of special location numbers, i.e., fire numbers, this has proven to be less than entirely satisfactory particularly at night when it is difficult to locate and read the numbers.

Moreover, in an emergency, it is often the case that the person telephoning emergency personnel will forget to give vital information. They may, for instance, give only partial or incomplete information about the nature of the emergency, their address, their fire number, their name, or other critical facts. As a result, it is often difficult for emergency personnel to respond rapidly in the most appropriate fashion with the equipment needed to deal with the emergency and, in many cases, valuable time is lost. This can result in tragedies that could have been avoided had there been available a fully operational distress system taking into account these factors. Accordingly, it has remained to provide a distress light and signal system of the type disclosed herein.

SUMMARY OF THE INVENTION

In accordance with the present invention, a distress light and signal system is disclosed. It incorporates light means adapted to be anchored in the ground in proximity to a road passing by a house and switch means for selectively actuating the light means in an emergency from within the house together with means for retaining information at a location remote from the house so that the information is immediately retrievable upon notification of the existence of an emergency at the house where the information includes, among other things, directions for use by a person responding to the emergency. With these features, the person responding to the emergency may reach the house rapidly by visually locating the light means upon reaching the vicinity of the house.

In a preferred embodiment, the light means includes a housing having a light source mounted therein. The light source may advantageously comprise a revolving reflector light surrounded by a colored translucent sleeve, and the housing may include an opaque tubular member releasably secured to a base where the tubular member has a platform at its upper end upon which the light source is mounted. With this construction, the housing may also include a clear dome releasably secured to the tubular member.

In addition, the clear dome is preferably releasably secured to the tubular member adjacent the platform. The translucent sleeve may then advantageously be disposed on the platform inwardly of the clear dome. With this arrangement, the reflector light will be concealed from view by the translucent sleeve.

In addition, the light means may advantageously include a solar collector mounted in the clear dome. It is also preferred for the tubular member to have a rechargeable battery disposed therein. As will be appreciated, the rechargeable battery is operatively connected to the solar collector.

In a preferred embodiment, the switch means includes a transmitter adapted to be retained in the house. The transmitter is adapted to send a signal at a preselected frequency from the house to the light means. In addition, the switch means also includes a receiver disposed within the light means.

Finally, the light means may advantageously include a telescopic post assembly. The post assembly is adjustable between a lowered position and a raised position. As will be appreciated, the post assembly is adapted to be mounted in the ground where it can be raised in the winter to prevent the light from being covered with snow.

These and other objects, features and advantages of the present invention will become even more apparent upon consideration of the accompanying specification, claims and drawings.

DESCRIPTION OF THE PREFERRED EMBODIMENT

Figure 1:
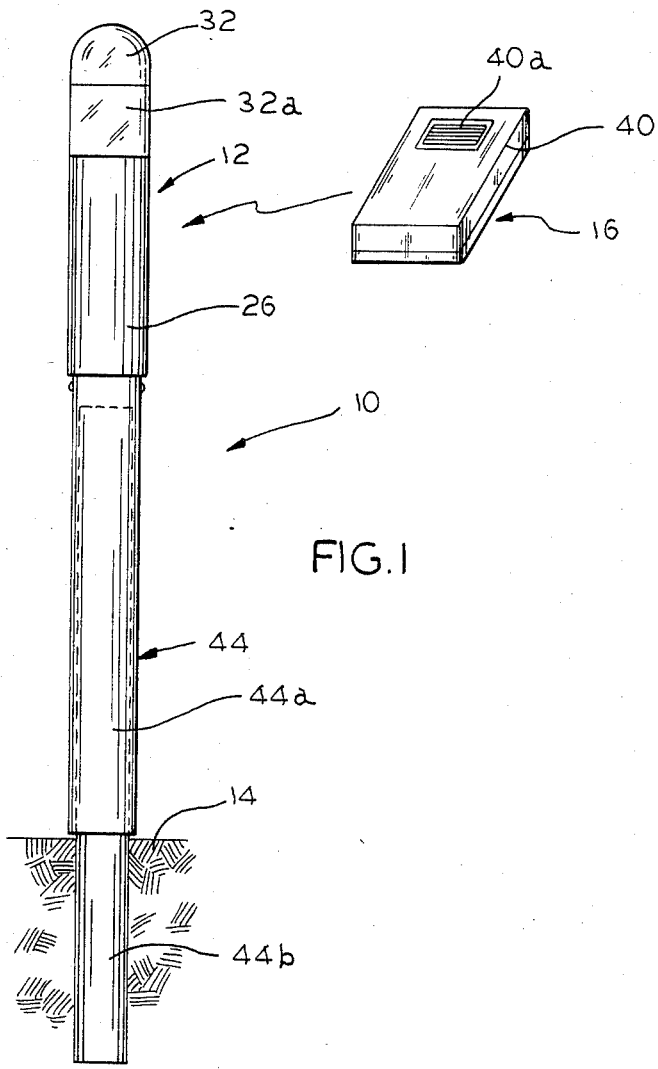
FIG. 1 is a front elevational view of a distress light and signal system in accordance with the present invention.

In the illustration given, and referring first to FIG. 1, the reference numeral 10 designates generally a distress light and signal system in accordance with the present invention. The system 10 includes light means 12 adapted to be anchored in the ground 14 in proximity to a road passing by a house, switch means 16 for selectively actuating the light means 12 in an emergency from within the house, and means for retaining information at a location remote from the house, such as the card 18 illustrated in FIG. 3, so that the information is immediately retrievable upon notification of the existence of an emergency at the house where the information includes, among other things, directions for use by a person responding to the emergency. With the distress light and signal system 10, the person responding to the emergency may reach the house rapidly by visually locating the light means upon reaching the vicinity of the house.

Figure 4:
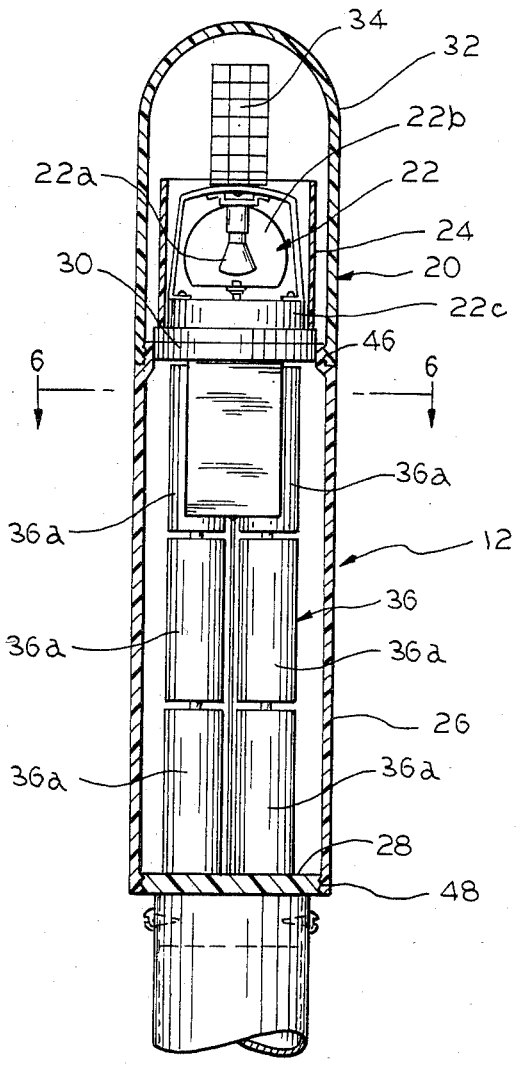
FIG. 4 is a cross sectional view of the distress light of FIG. 1 illustrating its working components.
Figure 5:
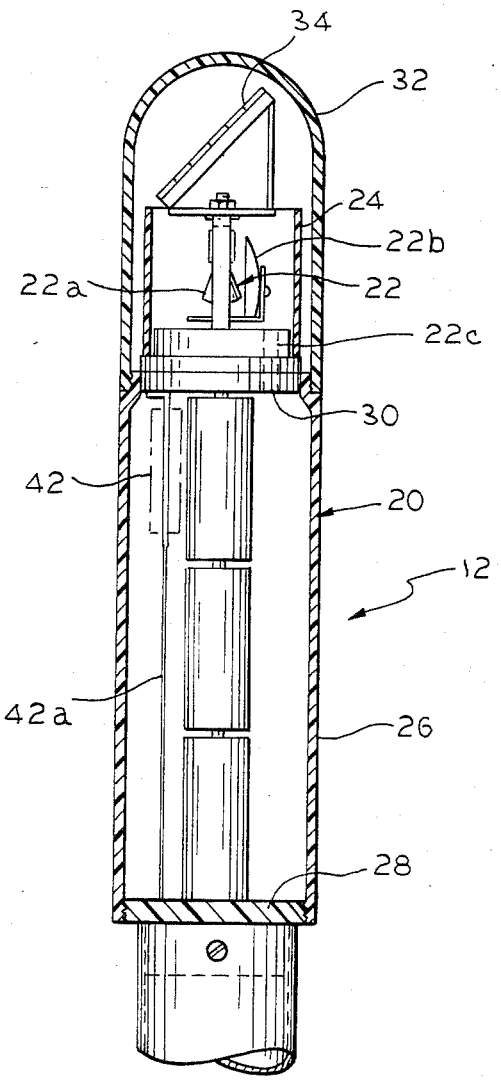
FIG. 5 is another cross sectional view of the distress light of FIG. 1 illustrating its working components.

Referring to FIGS. 4 and 5, the light means 12 includes a housing 20 having a light source 22 mounted therein. The light source 22 preferably comprises a revolving reflector light surrounded by a colored translucent sleeve 24, and the housing 20 includes an opaque tubular member 26 releasably secured to a base 28 where the tubular member 26 has a platform 30 at its upper end upon which the light source 22 is mounted. Moreover, the housing 20 includes a clear dome 32 releasably secured to the tubular member 26.

Preferably, the clear dome 32 is releasably secured to the tubular member 26 adjacent the platform 30. The translucent sleeve 24, as shown, is disposed on the platform 30 inwardly of the clear dome 32. As will be appreciated, the reflector light 22 is concealed from view by the translucent sleeve 24.

Figure 6:
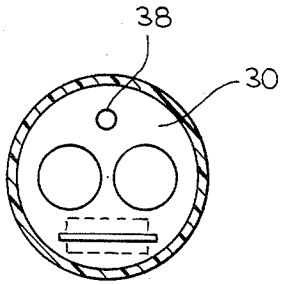
FIG. 6 is a cross sectional view taken on the line 6—6 of FIG. 4.

Additional details of the present invention include a solar collector 34 mounted in the clear dome 32 as part of the light means 12. It will also be seen that the tubular member 26 has a rechargeable battery pack 36 comprised of one or more rechargeable batteries 36*a* disposed therein. While not shown, the rechargeable battery pack 36 is operatively connected to the solar collector 34 by means of a wire passing through the aperture 38 in the platform 30 (see FIG. 6).

Referring now to FIGS. 1 and 5, the switch means 16 includes a transmitter 40 adapted to be retained in the house. The transmitter 40 is designed to send a signal at a preselected frequency from the house to the light means 12. In addition, the switch means 16 includes a receiver 42 disposed within the light means 12.

Figure 2:
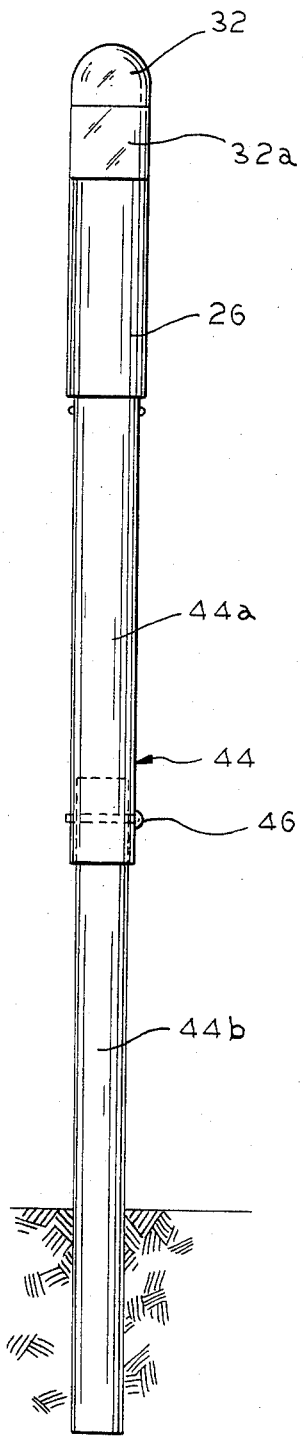
FIG. 2 is a front elevational view of the distress light of FIG. 1 illustrating the raised position thereof.

As will be appreciated by referring to FIGS. 1 and 2, the light means 12 includes a telescopic post assembly 44. The post assembly 44, which is comprised of telescoping post portions 44*a* and 44*b*, is adjustable between a lowered position (see FIG. 1) and a raised position (see FIG. 2). As previously mentioned, the post assembly 44 is adapted to be mounted in the ground 14 in proximity to a road passing by a house.

Figure 3:
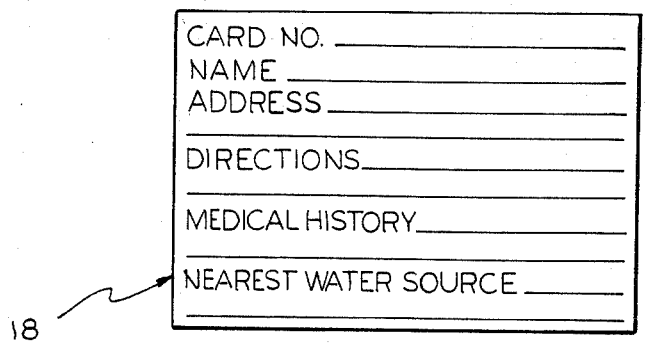
FIG. 3 is a schematic illustration of a card for retaining critical information by persons responding to emergencies.

Referring to FIG. 3, the system 10 includes means for retaining information at a location remote from the house in the form of the card 18. The card 18 is adapted to be maintained at the remote location, i.e., the location of persons normally responding to emergencies such as firemen, policemen and paramedics, and the card 18 is adapted to provide critical information relating to the house and persons residing therein. In particular, the information may include the card number, name, address, directions, medical histories, and/or nearest water source.

While a card is utilized in the invention for retaining the information, it will be appreciated by those skilled in the art that other information retaining means can be adopted. It is entirely possible, for instance, for every residence of a rural community to be issued an individual identification number which may be used by emergency personnel having a computer data base to retrieve information on a video screen upon receiving notification of an emergency and the information can be reproduced quickly and accurately by a printer associated with the computer system, or the same operation can be performed manually by filing cards by identification or card number. Whether using manual or machine retrieval systems, the fact remains that the distress light and signal system meets a serious need.

Referring to FIGS. 1 and 2, the light means 12 can be maintained in a lowered position (see FIG. 1) with the exception of the winter months when snow drifts might cover it from view. It is then possible to raise the light means 12 by utilizing the telescopic post assembly 44 which includes a fastener 46 for maintaining the post portion 44*a* in an elevated position relative to the post portion 44*b*. In a practical embodiment, the light means 12 can be made adjustable between a minimum desired height and a maximum desired height by varying the vertical dimensions of the post portions 44*a* and 44*b*.

Still referring to FIGS. 1 and 2, the opaque tubular member 26 is preferably formed of black plastic to conceal the battery pack 36, receiver 42 and antenna 42*a*. It will also be appreciated that the clear dome 32 extends above the tubular member 26 but, due to the position of the colored translucent sleeve 24 (which may advantageously be blue or red since such colors are often associated with emergencies and emergency vehicles), the lower portion of the clear dome 32 (as at 32*a*) will appear blue or red upon visual inspection and will be the area of the light means 12 that will give off a revolving light upon actuation of the light means 12 with the transmitter 40. In this connection, the light means 12 can be actuated by the transmitter 40 from many locations in the house due to the fact that the transmitter 40 is entirely portable in nature.

Referring to FIG. 1, the transmitter 40 is suitably of the type normally associated with garage door openers. It is a small, rectangular, hand held, battery operated device which includes a push button 40*a* which, when depressed, sends a signal at a preselected frequency from the house to the light means 12. Due to the limited use of the transmitter 40, the batteries will normally last for an extended period of time.

In practice, the solar collector 34 is mounted so as to be disposed at approximately a 45° angle and the light means 12 will be oriented so that the solar collector 34 faces in a generally southerly direction. With the clear dome 32, the solar collector 34 will maintain an adequate charge in the rechargeable battery pack 36 which typically will last for an extended period of time. In this connection, the battery pack 36 will illuminate the lightbulb 22*a* and rotate the reflector 22*b* by supplying power to the motorized base 22*c* of the light 22 upon actuation of the light means 12.

If there is a need to replace any of the components, the light means 12 is easily accessible to the homeowner. It is simply necessary to remove the clear dome 32 which is preferably threaded onto the tubular member 26 as at 46 and remove the tubular member 26 which is preferably threaded onto the base 28 as at 48. When this has been done, the light 22, the solar collector 34, the battery pack 36, and the receiver 42 are readily accessible.

With the present invention, a unique distress light and signal system has been provided. It is well adapted not only to limit or prevent damage to property but, more importantly, to help save human lives and, when the distress light, transmitter, and information retaining means are united in the unique system disclosed herein, a safety device of great value filling a significant void has been provided. Moreover, even without the information retaining means of the invention, the distress light is capable of saving human lives by giving the use a way to notify neighbors of the existence of an emergency such as a fire, serious illness, or burglar in the home.

Various changes coming within the spirit of the present invention may suggest themselves to those skilled in the art. Hence, it will be understood that the invention is not to be limited to the specific embodiments shown and described or the uses mentioned. On the contrary, the specific embodiments and uses are intended to be merely exemplary with the present invention being limited only by the true spirit and scope of the appended claims.

I claim:

1. A distress signal system for guiding emergency personnel to a house in a rural location, comprising;

light means adapted to be mounted in proximity to a road passing by a house, said light means including a housing having a light source mounted therein, said light source comprising a revolving reflector light surrounded by a colored translucent sleeve;

said housing including an opaque tubular member with an upper end and a lower end, said tubular member having a platform at its upper end upon which said light source is mounted, said housing also including a clear dome releasably secured to said tubular member;

said light means further including a solar collector mounted in said clear dome, said tubular member having disposed therein a rechargeable battery operatively connected to said solar collector;

switch means for selectively actuating said light means in an emergency from within said house; and means for retaining directional information at a location remote from said house so as to direct an emergency team to said house and to provide emergency information if necessary;

whereby an internally powered distress signal system for rural locations provides emergency personnel with directions to the site of the emergency and visually identifies an emergency location.

2. The distress signal system as defined by claim 1 wherein said solar collector is mounted on a telescopic pole at approximately a 45° angle and oriented so that said solar collector faces in a generally southerly direction whereby said battery operatively connected to said solar collector and contained within said telescopic pole may be charged for supplying electrical power to said signal system.

3. The distress signal system as defined by claim 1 wherein said switch means includes a transmitter adapted to be retained in said house, said transmitter being adapted to send a signal at a preselected frequency from said house to said light means, said switch means also including a receiver disposed within said light means.

4. The distress signal system as defined by claim 1 wherein said light means includes a telescopic post assembly, said post assembly being separable into an upper portion and a lower portion, said lower portion being adapted for easy insertion into the ground and subsequent attachment to said upper portion of said telescopic post assembly, said post assembly being adjustable between a lower position and a raised position.

5. The distress signal system as defined by claim 1 wherein said information retaining means includes a card adapted to be maintained at a location of persons responding to emergencies, said card being adapted to provide critical information relating to said house and persons residing therein, said information including card number, name, address, directions, medical histories, and/or nearest water source.

* * * * *